US006263657B1

(12) United States Patent
Fietz

(10) Patent No.: US 6,263,657 B1
(45) Date of Patent: Jul. 24, 2001

(54) SUPPORTING PLATE FOR THE SUPPORT OF A ROTOR

(75) Inventor: Roland Fietz, Neustadt (DE)

(73) Assignee: Firma Carl Frudenberg, Weinheim (DE)

( * ) Notice: Subject to any disclaimer, the term of this patent is extended or adjusted under 35 U.S.C. 154(b) by 0 days.

(21) Appl. No.: 09/517,482

(22) Filed: Mar. 2, 2000

(30) Foreign Application Priority Data

Mar. 2, 1999 (DE) ..... 199 08 922

(51) Int. Cl.[7] ..... D01H 1/24
(52) U.S. Cl. ..... 57/406; 384/549
(58) Field of Search ..... 57/400, 404, 406, 57/92, 407; 384/549, 548

(56) References Cited

U.S. PATENT DOCUMENTS

| | | | | |
|---|---|---|---|---|
| 4,713,932 | * | 12/1987 | Zott | 57/406 |
| 4,893,946 | * | 1/1990 | Tesh et al. | 384/549 |
| 4,896,976 | * | 1/1990 | Stahlecker | 384/549 |
| 5,221,133 | * | 6/1993 | Braun et al. | 384/549 |
| 5,362,160 | * | 11/1994 | Braun et al. | 384/549 |
| 5,423,616 | * | 6/1995 | Gotz | 384/549 |
| 5,517,814 | * | 5/1996 | Stahlecker | 57/406 |
| 6,116,012 | * | 9/2000 | Braun | 57/406 |

FOREIGN PATENT DOCUMENTS

| | | | | |
|---|---|---|---|---|
| 84 33 579 | | 4/1985 | (DE) . | |
| 3615777 | * | 11/1987 | (DE) | 57/406 |
| 37 19 445 | | 12/1988 | (DE) . | |
| 4102142 | * | 7/1992 | (DE) . | |
| 42 27 489 | | 3/1994 | (DE) . | |
| 195 11 000 | | 3/1996 | (DE) . | |

* cited by examiner

*Primary Examiner*—Danny Worrell
(74) *Attorney, Agent, or Firm*—Kenyon & Kenyon

(57) ABSTRACT

A supporting plate for the support of a rotor, in particular of an open-end spinning rotor, having a hub ring and a support ring arranged on the exterior periphery of the hub ring. The support ring has a contact surface for the rotor, the exterior periphery of the hub ring and the interior periphery of the support ring are joined to each other with positive locking. The support ring has a cramp-like shape in cross-section and is formed from a bridge part, provided with the contact surface for the rotor, the bridge part having two lateral clamping anchors emerging from the respective ends of the bridge part and oriented to the inside both radially as well as axially.

25 Claims, 3 Drawing Sheets

SUPPORTING PLATE FOR THE SUPPORT OF A ROTOR

BACKGROUND OF THE INVENTION

The form of supporting plates for the support of rotors, in particular of open-end spinning rotors, has been the subject of many studies and designs. The high speeds required in these rotors, today reaching a maximum of 150,000 RPM in the rotor and having a tendency to ever higher rotational speeds, lead to a considerable heating up of the supporting plates, in particular of the support ring situated on it. This heat must be dissipated because it is often the cause of damage to the support ring.

The above-mentioned problem is addressed by German Patent GM 84 33 579. In order to increase the surface life of the spinning rotor at extremely high rotational speeds, provision is made in the contact surface of the support ring for a circumferential ring groove. In this manner, it is thought to achieve an improvement in the heat dissipation, so that the danger of heat accumulation inside the support ring is reduced.

German Patent PS 195 11 000 also concerns a supporting plate having improved cooling, in order thus to achieve a longer surface life of the supporting plate. For this purpose, the support ring is provided with cooling fins, which provide thermal relief.

The heat arising in the support ring, in connection with the flexing work in the polymer support ring, can lead to the separation of the support ring from the hub ring. In order to avoid this, it is necessary to anchor the support ring to the hub ring very well. German Laid-Open Print 42 27 489 deals with this problem and provides for a profiling, by which support ring and hub ring are joined to each other. However, the manufacture of the profiling in this case is extremely expensive. Furthermore, in this design, the heat dissipation is critical in the relatively thick edge areas of the support ring.

The problem of heating and the related problem of wear is also the subject of German Laid-Open Print 37 19 445. For this purpose, provision is made there for introducing a highly planar ring groove into the contact surface of the support ring, to reduce the stress in this area on the supporting plate by the shaft of the spinning rotor. The contact surface is to be relieved in its central area.

Finally, U.S. Pat. No. 4,713,932 should also be mentioned, in which, for heat dissipation, the support ring has a reduced thickness in its center, so that at least in the central area of the support ring the amount of heat generated will be less, while also maintaining a sufficient damping capacity. Here, too, the relatively thick edge areas generate problems in heat dissipation.

SUMMARY OF THE INVENTION

The present invention, therefore, is based on the objective of creating a supporting plate for the support of a rotor, in particular for open-end spinning rotors, the plate being composed of a hub ring and a support ring arranged on the exterior periphery of the hub ring, the support ring having a contact surface for the rotor, the exterior periphery of the hub ring and the interior periphery of the support ring being joined to each other with positive locking. The supporting plate is thus further improved with regard to rotor heating, wear effects, as well as rotor shaft soiling.

It should be noted quite generally that in the related art little attention is paid to the fact that in recent generations of engines tending to ever higher rotor speeds, it is not only the central area of the support ring that is jeopardized, but also increasingly the lateral edge areas as well. Furthermore, rotor shaft soiling plays an ever larger role, the greater the rotational speed. It results from air-borne particles in the spinning box, which arrive at the rotor shaft via electrostatic charging and build up as a result of the flexing effect of the supporting plate. The present invention takes account of the above-mentioned points through its supplemental, good heat dissipation in the central support ring area, improved heat dissipation in the edge areas, and improved performance with respect to dissipating the electrostatic charging.

The objective is achieved in the supporting plate of the above-mentioned type according to the invention through the fact that the support ring, seen in cross-section, has a cramp-like shape and is composed of a bridge part provided with the contact surface for the rotor, the bridge part having two lateral clamping anchors, emerging from the respective ends of the bridge part and aligned to the inside both radially as well as axially. A supporting plate of this type has an extremely simple design, and good heat dissipation from the support ring to the hub ring is achieved.

Advantageously, the contact surface of the support ring and the interior surface, in contact with the hub ring, of the bridge part of the support ring can be oriented parallel to each other. In the same manner, the respective lateral surfaces of a clamping anchor can run parallel to each other. The ends of the clamping anchors can be given a blunt configuration and can be provided with end surfaces preferably aligned so as to be perpendicular with respect to the respective lateral surfaces of the clamping anchors.

In the context of the conception of the invention, other embodiments are within the scope of the invention. Thus the interior surface, in contact with the hub ring, of the bridge part of the support ring can be designed so as to be concave and the contacting surface of the hub ring so as to be convex, in order to further aid heat dissipation in the center of the support ring. In addition, the clamping anchors can be provided with lateral surfaces, which form an additional positive locking, as a result of the lateral surfaces, seen in a side view, being provided with a dovetail shape or with undercuts, which yield lateral grooves.

As is generally known, the hub ring can be made of a metallic material or a heat-conducting plastic. The support ring, for its part, is composed of a polymer material. The Shore hardness of the polymer material is less than 98, preferably less than 96 Shore hardness A, i.e., a relatively soft polymer material being selected for the support ring, so that good vibration damping is achieved. Consequently, the thickness of the bridge part of the support ring can be reduced and a thickness can be selected in a range of under 4 mm. A preferred range lies around 2.5 mm.

The clamping anchors are aligned at an angle of 10° to 45°, preferably 38°, with respect to the radial central surface of the supporting plate. In this manner, an adequate anchoring of the support ring on the hub ring is achieved. The hub ring itself is provided on its exterior periphery with two ring grooves, which receive the clamping anchors. The ring grooves are arranged preferably symmetrically with respect to the radial central surface of the supporting plate. In their contour, the ring grooves correspond to the contour of the clamping anchor and are oriented at the same angle of 10° to 45°, preferably at 38°, with respect to the radial central surface of the supporting plate.

The depth of the ring grooves, measured from the exterior periphery of the hub ring in the direction of the turning axis of the plate, is equal to or larger than the thickness of the clamping anchors.

Support for the heat dissipation and an improved dissipation of the electrostatic charging from the edge areas of the support ring are achieved through the fact that the ring grooves of the hub ring are arranged at a lateral distance to the lateral surfaces of the hub ring. In this manner, improved heat dissipation and electrostatic dissipation from the edge areas of the support ring to the hub ring are achieved.

The new supporting plate provides very good heat dissipation, the wear of the contact surface is reduced, and, as a result of the relatively thin coating of relatively soft material, a very favorable damping performance is achieved. It has also been shown that rotor shaft soiling is less than in the case of coatings of greater thicknesses.

In addition, the manufacture of the supporting plate is simplified because the hub ring can be manufactured in a casting press process or by machining. For example, the ring grooves can be formed in a milling process by cutting using a pointed tool. The support ring can be applied to the hub ring in an injection molding process. The softer material makes it possible to use this process.

DETAILED DESCRIPTION OF THE INVENTION

Figure 1:
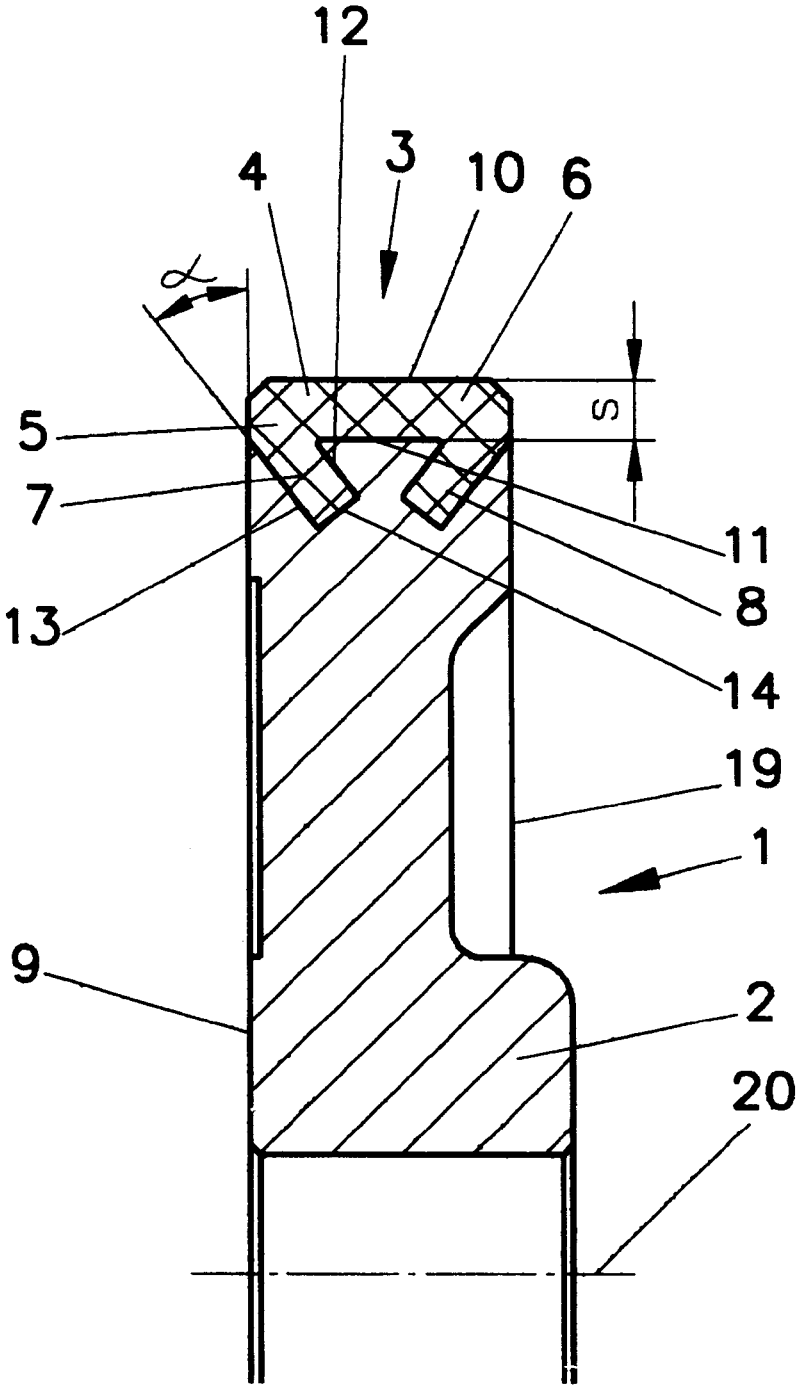
FIG. 1 shows the upper half of the supporting plate in cross-section.

In FIG. 1, one half of the supporting plate 1 is depicted in cross-section. Supporting plate 1 is essentially composed of hub ring 2 and support ring 3 joined to it with positive locking. Support ring 3 has the shape of cramp, which is composed of a bridge part 4 and two lateral clamping anchors 7,8 emerging from respective ends 5,6 of bridge part 4. Clamping anchors 7 and 8 are aligned at an angle of 38°, with respect to lateral surfaces 9,19 of supporting plate 1, and in this manner are securely anchored in hub ring 2. Lateral surfaces 9,19 run parallel to an imagined central surface 18 of supporting plate 1.

Contact surface 10 of support ring 3 and interior surface 11, in contact with hub ring 2, of bridge part 4 of support ring 3 run parallel to each other. Similarly, lateral surfaces 12 and 13 of clamping anchors 7 and 8 run parallel to each other. The ends of clamping anchors 7 and 8 are provided with end faces 12 and 14 oriented perpendicular with respect to lateral surfaces 12 and 14 of clamping anchors 7 and 8. At this point it should be noted that end faces 14 can also adopt a different position; for example, a parallel orientation of end faces 14 to interior surface 11 can result in good heat dissipation, since in this manner a large quantity of material of hub ring 2 is concentrated in edge areas 5,6 of bridge part 4.

Hub ring 2 is made of a metallic material having good heat conductivity, in the present case, aluminum. Support ring 3 is made of a plastic having high heat stability; in this context, the plastic is selected so that its Shore hardness is less than 96 A Shore hardness. This relatively soft material permits thickness S of bridge part 4 to be roughly 2.5 mm. As a result of the design configuration of hub ring 2 of support ring 3 and also of the selection of material, a good dissipation of the resulting heat is achieved from support ring 3 to hub ring 2, both in the central area as well as in the edge areas.

Figure 2:
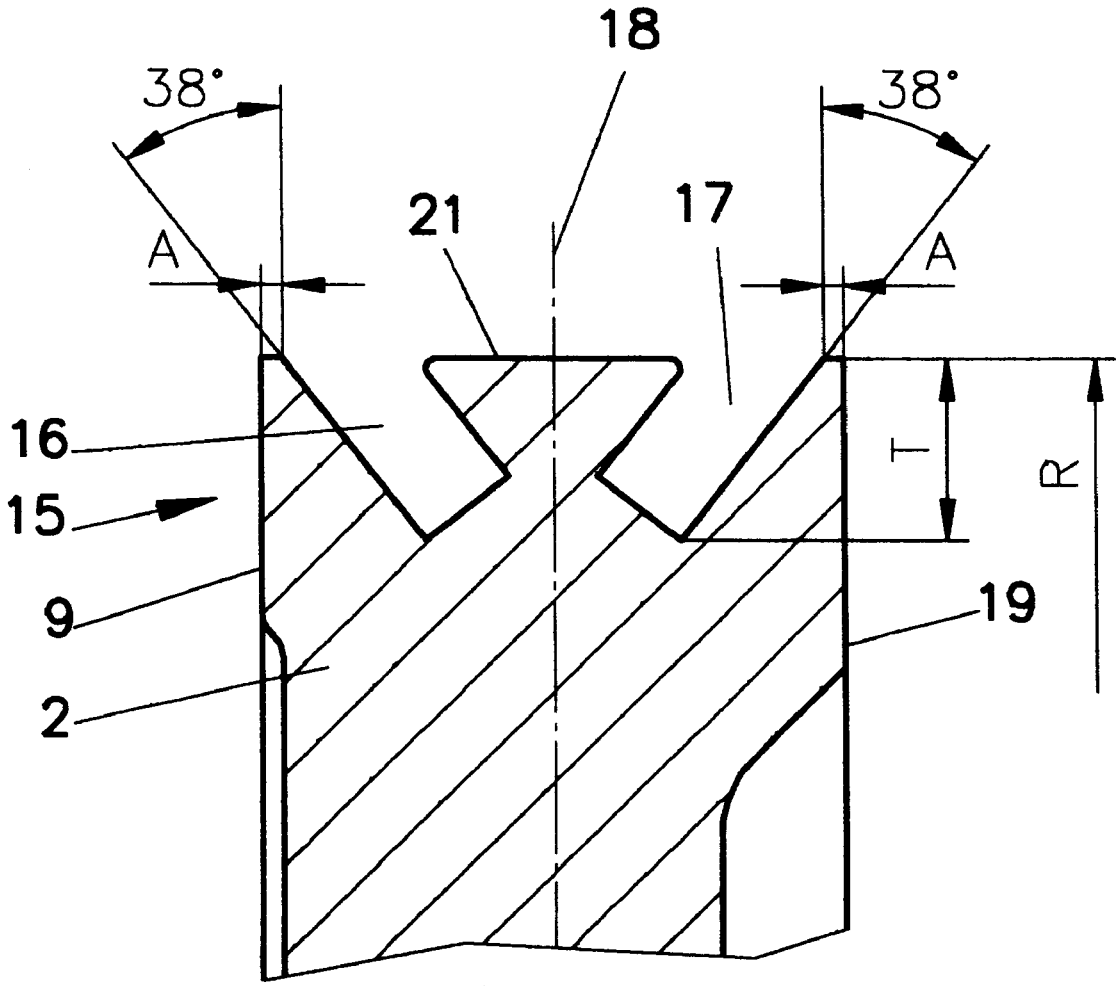
FIG. 2 shows an enlargement of the exterior area of the hub ring, also in a cutaway view.

In FIG. 2, exterior periphery 15 of hub ring 2 is depicted in an enlargement. In exterior periphery 15, ring grooves 16 and 17 are introduced, which have the same shape as clamping anchors 7 and 8. Ring grooves 16 and 17 are arranged symmetrically with respect to radial central plane 18 of supporting plate 1.

Ring grooves 16 and 17 have the same shape as clamping anchors 7 and 8 and are also oriented at the same angle $\alpha$ as clamping anchors 7 and 8. In addition, depth T of ring grooves 16 and 17 corresponds to the length of clamping anchors 7 and 8. It is dimensioned such that it is the same as or greater than thickness D of clamping anchors 7 or 8, measured from exterior periphery 15 of hub ring 2 in the direction of rotating axis 20 of supporting plate 1.

Ring grooves 16 and 17 are also arranged at a lateral distance A from lateral surfaces 9 of hub ring 2. As a result, the metallic material of hub ring 2 is concentrated directly at edge areas 5,6 of support ring 3. The lateral surfaces of support ring 3, in this context, are aligned with lateral surfaces 9,19 of hub ring 2. The design selected provides good support of support ring 3 by hub ring 2 and good heat dissipation from the edge areas, as well as an improved dissipation of electrostatic charging from the support ring and engine shaft, and therefore an improved performance with respect to rotor shaft soiling.

Ring grooves 16 and 17 can be formed very precisely in a milling process by cutting. Support ring 3 is applied to hub ring 2 in an injection molding process.

Figure 3:
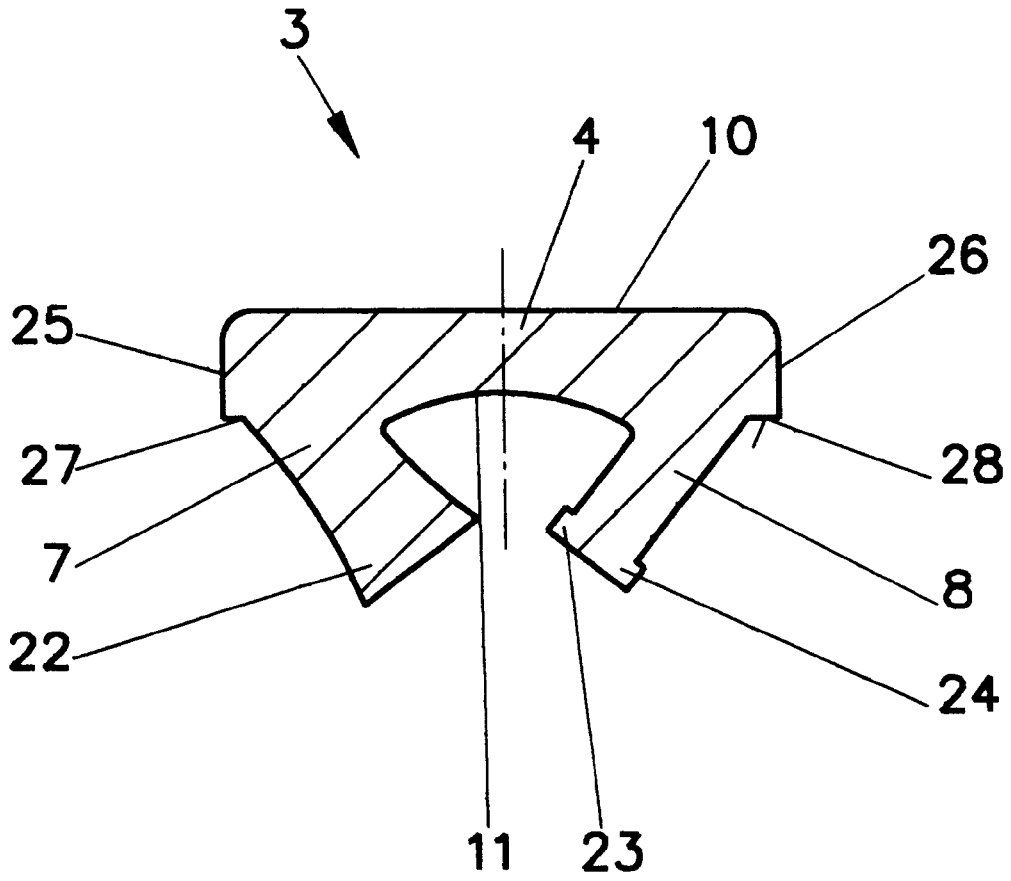
FIG. 3 shows a cross-section of a support ring.

In FIG. 3, a support ring 3 is shown in cross-section. In this context, on the left side, support ring 3 is shown having a clamping anchor 7 in dove-tail shape 22, and on the right side having a clamping anchor 8 in the shape of two lateral undercuts 23 and 24. Contact surface 10 is configured so as to be level. Interior surface 11, situated below, of bridge part 4 of support ring 3 is configured so as to be concave. Corresponding surface 21 of hub ring 2 has a corresponding convex shape. This configuration permits good heat dissipation from the central part of support ring 3.

Extreme lateral ends 25 and 26 of support ring 3 have extensions 27 and 28, at which the ends adjoin the exterior lateral areas of hub ring 2.

What is claimed is:

1. A supporting plate for supporting a rotor, in particular open-end spinning rotors, comprising:

a hub ring having an exterior periphery, the hub ring being provided on its exterior periphery with two ring grooves, support ring arranged on the exterior periphery of the hub ring, the support ring having a contact surface for the rotor, the exterior periphery of the hub ring and an interior periphery of the support ring being joined to each other with positive locking, wherein the support ring is further comprised of a bridge part, provided with the contact surface for the rotor, the bridge part having two lateral clamping anchors and two ends, the lateral clamping anchors emerging from the ends of the bridge part and oriented to the inside both radially and axially in a dove-tail shape, the lateral clamping anchors extending into the ring grooves.

2. The supporting plate as recited in claim 1, wherein the contact surface of the support ring and the interior surface, in contact with the hub ring, of the bridge part of the support ring run parallel to each other.

3. The supporting plate as recited in claim 1, wherein the interior surface, in contact with the hub ring, of the bridge part of the support ring is configured so as to be concave and the adjoining surface of the hub ring is configured so as to be convex.

4. The supporting plate as recited in claim 1, wherein the respective lateral surfaces of the clamping anchors run parallel to each other.

5. The supporting plate as recited in claim 2, wherein the respective lateral surfaces of the clamping anchors run parallel to each other.

6. The supporting plate as recited in claim 1, wherein the ends of the clamping anchors are configured so as to be blunt and have end faces that are aligned so as to be perpendicular to the respective lateral surfaces of the clamping anchors.

7. The supporting plate as recited in claim 1, wherein the ends of the clamping anchors are configured so as to be blunt and preferably have end faces that are aligned so as to be perpendicular to the respective lateral surfaces of the clamping anchors.

8. The supporting plate as recited in claim 1, wherein the ends of the clamping anchors have a profiling, specifically having a rounded-off shape.

9. The supporting plate as recited in claim 1, wherein the hub ring is made of a metallic material.

10. The supporting plate as recited in claim 1, wherein the support ring is made of plastic.

11. The supporting plate as recited in claim 1, wherein the support ring is made of a polymer material.

12. The supporting plate as recited in claim 11, wherein the Shore hardness of the polymer material is less than 98 Shore hardness.

13. The supporting plate as recited in claim 1, wherein the thickness (S) of the bridge part is less than 4 mm.

14. The supporting plate as recited in claim 1, wherein the clamping anchors are oriented at an angle $\alpha$ of 10° to 45° with respect to the radial central plane of the supporting plate.

15. The supporting plate as recited in claim 1, wherein the ring grooves are arranged so as to be symmetrical with respect to the radial central plane of the supporting plate.

16. The supporting plate as recited in claim 1, wherein the ring grooves are oriented at an angle $\alpha$ of 10° to 45° with respect to the radial central plane of the supporting plate.

17. The supporting plate as recited in claim 1, wherein the depth (T) of the ring grooves is equal to or greater than the thickness of the clamping anchors, measured from the exterior periphery of the hub ring in the direction of the rotating axis of the supporting plate.

18. The supporting plate as recited in claim 1, wherein the ring grooves are arranged so as to have a lateral distance (A) with respect to the lateral surfaces of the hub ring.

19. The supporting plate as recited in claim 1, wherein the hub ring is manufactured in a milling process using machining.

20. The supporting plate as recited in claim 1, wherein the hub ring is manufactured of plastic in an injection molding, extrusion, or pressing process.

21. The supporting plate as recited in claim 1, wherein the ring grooves are manufactured in a milling process by cutting using a pointed tool.

22. The supporting plate as recited in claim 1, wherein the support ring is applied to the hub ring in an injection molding, extrusion, or pressing process.

23. The supporting plate as recited in claim 12, wherein the Shore hardness of the polymer material is less than 96 Shore hardness.

24. The supporting plate as recited in claim 1, wherein the thickness (S) of the bridge part is roughly 2.5 mm.

25. The supporting plate as recited in claim 1, wherein the clamping anchors are oriented at an angle $\alpha$ of 38° with respect to the radial central plane of the supporting plate.

* * * * *